United States Patent [19]

Bemis et al.

[11] 4,313,767

[45] Feb. 2, 1982

[54] METHOD AND APPARATUS FOR CLEANING CONTAINERS WITH AN IONIZED GAS BLAST

[75] Inventors: Lester E. Bemis, Schaumburg; Charles M. Kincaid, Elgin, both of Ill.; Hugh L. White, Warrenton, Mo.

[73] Assignee: American Can Company, Greenwich, Conn.

[21] Appl. No.: 183,589

[22] Filed: Sep. 2, 1980

Related U.S. Application Data

[63] Continuation-in-part of Ser. No. 100,196, Dec. 4, 1979, abandoned.

[51] Int. Cl.[3] ..... B08B 5/02; B08B 9/08

[52] U.S. Cl. ..... 134/1; 15/1.5 R; 134/10; 134/23; 134/25.4; 134/37; 134/94

[58] Field of Search ..... 134/1, 10, 23, 25.4, 134/36, 37, 94, 102, 171; 15/1.5 R, 304, 306 B, 406

[56] References Cited

U.S. PATENT DOCUMENTS

| | | | |
|---|---|---|---|
| 3,071,497 | 1/1963 | Hinson | 134/1 |
| 3,117,726 | 1/1964 | Schoberg | 134/37 X |
| 3,159,164 | 12/1964 | McBrady | 15/304 X |
| 3,208,613 | 9/1965 | Brainard | 15/304 X |
| 3,837,915 | 9/1974 | Erb | 134/1 |
| 4,132,567 | 1/1979 | Blackwood | 134/1 |

*Primary Examiner*—Marc L. Caroff

*Attorney, Agent, or Firm*—Robert P. Auber; George P. Ziehmer; Stuart S. Bowie

[57] ABSTRACT

A method and apparatus for cleaning particulate matter from container bodies. Container bodies are conveyed, open end down, along a corridor formed by two parallel pressurized fluid curtains. The container bodies pass over a series of nozzles which subject the interior of the containers to blasts of ionized gas. The ionized gas neutralizes any electrostatic charges and expells the particulate matter from the container. The curtaining sweeps the expelled particles into a spray mist region where they are entrained and subsequently condensed into a waste stream for disposal. The apparatus features a tunnel which substantially separates the fluid curtaining from the spray mist region. An outer housing enclosing the spray mist region is fabricated of transparent plastic to permit visual monitoring.

12 Claims, 3 Drawing Figures

METHOD AND APPARATUS FOR CLEANING CONTAINERS WITH AN IONIZED GAS BLAST

BACKGROUND OF THE INVENTION

This is a continuation-in-part of my copending application, the same title, Ser. No. 100,196 filed on Dec. 4, 1979, now abandoned.

High speed canning or can making operations entail the rapid transfer of open ended can bodies from one location to another. This high speed transfer results in a unique soiling problem in that the decorated can body, by virtue of its rapid movement along the conveyor rails, generates an electrostatic field within the container which attracts particulate contaminants such as wood, paper, metal etc. Since the can bodies are insulated with a varnish, the electrostatic charge is not readily dissipated and the particles cling tenaciously to the container walls. A substantial portion of the can bodies produced ultimately become containers for food or beverages and consequently there is a continuing effort not only to guard against contamination but further to ensure that the containers are purged of extraneous material prior to use. A can washer will remove the large particles but the finer contaminants are adherent and are frequently even more difficult to remove when wet.

Most efforts directed to the dry cleaning of containers have entailed the use of a pressure jet of air in cooperation with a vacuum as disclosed by Brainard in U.S. Pat. 3,208,613 or by McBrady in U.S. Pat. No. 3,159,164. The disclosed apparatus is most effective in the removal of gross particles and has little or no effect upon the particulate contaminant matter which is electrostatically attracted to the container walls. In addition, the apparatus tends to be slow, complicated and may itself contribute to the generation of particulate contaminants.

Accordingly, it is an object of the instant invention to provide a method which effectively purges the container body of particulate contaminants including those particles retained on the container walls by electrostatic attraction.

It is further an object of the instant invention to provide a method which is compatible with high speed operation where cans are conveyed at speeds up to 1250 can per minute.

Finally, it is an object of the instant invention to provide an apparatus which may be readily incorporated into an existing conveyor line, which may be readily monitored and which entails a minimum of moving parts.

SUMMARY OF THE INVENTION

It may be seen that the aforementioned objects of the invention may be attained in a method in which hollow container bodies are cleaned of particulate matter by moving the container bodies open end downward along a corridor, formed by parallel pressurized fluid curtains, and subjecting the interior of the container bodies to a blast of ionized gas to expell the particulate matter therefrom. The expelled particulate matter is entrained in a liquid spray mist which is subsequently condensed to form a waste stream, which may then be collected and discharged. It is preferable that the curtaining fluid be air, but alternatively it may be another gas, or even a liquid such as water. It is further preferable that the ionizing gas be air. The spray mist which is preferably water should surround the curtaining.

A system for carrying out the aforementioned process may be constructed by combining a means for supporting and conveying container bodies along a corridor, open end down and including, within the corridor, means which are designed to subject the interior of the container bodies to an upward blast of ionized gas. Pressurized curtaining provided longitudinally along either side of the conveying means to constrain the dispersion of the ionized gas, thereby preventing the recontamination of freshly purged container bodies. A housing means, with an entrance and an exit, provided with spray misting means, surrounds the pressurized curtaining means, to saturate and wash down the regions, thereby collecting, separating, and entraining the particulate matters in the mist for subsequent removal. It is preferable that the system include a tunnel means, which separates the curtaining means from the housing, thereby preventing the direct impingement of the spray mist onto the pressurized curtain. It is further desirable that the system be designed with a tray bottom which includes a condenser to assist in the condensation of the mist. A housing constructed of transparent material is desirable, since it facilitates monitoring of the operation.

Finally, it is preferable that the ionizing nozzle barrels which are provided with cooling vent openings be disposed so as to avoid accidental contamination of the ionizing chamber. By placing the nozzle barrels outside of the housing, remote from the container body, and conveying the ionized gas blast into the housing to the container by means of nozzle extention tubes, the chance of inadvertent contamination and shorting of the ionizing element by moisture may be minimized. Mounting the several nozzles on a plenum of substantial volume facilitates equal gaseous flow through each of the nozzles. A slotted pipe disposed transversely across the tray bottom proximate the entrance end of the housing blankets the tray surface with a flowing liquid, typically water, to ensure continuous flushing.

DETAILED DESCRIPTION OF THE ILLUSTRATED EMBODIMENT

Figure 1:
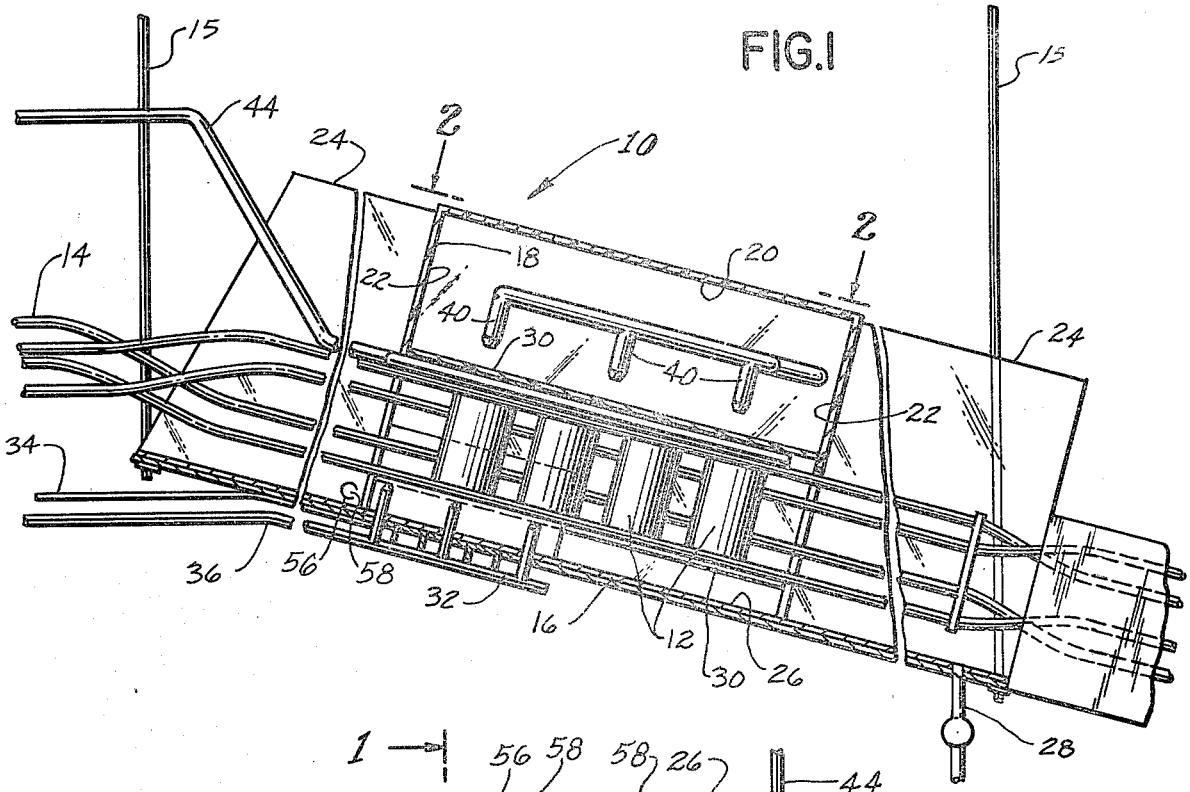
FIG. 1 is a fragmentary sectional view of a front elevation of a system for cleaning can bodies embodying the present invention and taken through the plane 1—1 of FIG. 2.

Turning now in detail to FIG. 1 of the appended drawings, therein illustrated, is the improved system for cleaning container bodies embodying the present invention and consisting of a conveyor; a tunnel provided with ionizing nozzles and pressure curtaining manifolds; and a housing which includes misting sprayers, a condensing tray and drain.

The conveyor 14 receives can bodies 12 from a depalletizer (not shown), and conveys them in close array to the cleaner 10. The cans advance through the system at a rate of up to 1250 cans per minute. Cleaner 10, supported by hangers 15, is designed to purge the can of particulate matter such as litho flakes, chipboard fiber etc. which cling to the interior walls of the container due to electrostatic attractions. The purged container body which is substantially free from particulate matter is then advanced by means of the conveyor to a can rinser (not shown) for further cleaning.

The housing 16 of cleaner 10 is constructed of ⅜" thick acrylic sheet. A center section 18 is provided with a hinged access cover 20, and end panels 22. Each of the end panels 22 are provided with openings through which the conveyor passes. The sides of the cleaner extend beyond the center section to form entrance and exit shields 24. No cover is required on the extremities of the housing. The base of the unit 26 extends for the entire length of the housing and is fabricated of stainless steel. The edges of the base are turned up to form a tray. A drain 28 is provided in the base proximate the exit end. A tunnel 30 substantially encloses the top and sides of the conveyor in its passage through the central portion of the housing to prevent direct impingement of the spray mist on the pressure curtain. A group of three or more air blast Simco ionizing nozzles 32 are mounted beneath the conveyor in the base of the tunnel. A power supply (not shown) Model H166 manufactured by Simco Company Inc., of Lansdale, Pa., provides the energy for activating the ionizing element of the ionizing nozzles. A power cable 34 connects the nozzles with the power supply. The nozzles are provided with high pressure dry filtered air from a source not shown. A pair of manifolds 38 are provided in the upper region of the tunnel to provide a pressurized curtain around the containers to constrain the dispersion of ionized purging gas as it leaves the container bodies with the particulate matter. The manifolds consist of ½" diameter copper tubing with a series of 0.015" diameter tubes on 1" centers drilled through the underside of the tubing. A series of six atomizing nozzles 40 connected to a supply 42 are disposed in the upper region of the central portion of the housing, above the tunnel, to provide an enveloping spray mist around the tunnel. The atomizing nozzles are 1/4NN3 nozzles manufactured by Spray Systems Company of Wheaton, Ill., each of the six nozzles delivers 3 gallons of water per hour.

Figure 2:
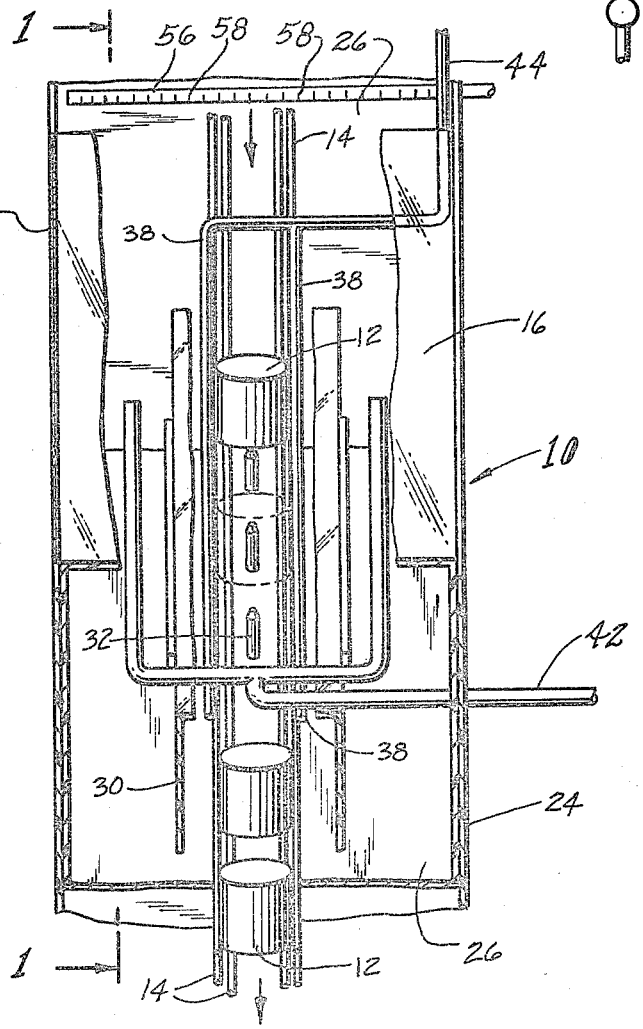
FIG. 2 is a fragmentary top view of the central portion of FIG. 1 as designated by the arrows 2—2, with the hinged cover and the top of the tunnel broken away to expose the ionizing nozzles, and their relationship to the conveyor, the can bodies and the pressure curtaining manifolds.

FIG. 2 shows the center section as indicated by arrows 2—2 of FIG. 1 as viewed from above. A portion of hinged cover 20 and the tunnel 30 are broken away to expose the container bodies 12, the conveyor rails 14 and the curtaining manifolds 38. The three or more air blast ionizing nozzles 32 are shown projecting from base 26 and positioned to subject each of the passing container bodies to a blast of ionized air.

In operation, dry can bodies 12 are conveyed from a depalletizing operation (not shown) along conveyor 14 in a vertical disposition. Before the can bodies enter cleaner 10 they are reoriented into a vertical mode with the open end down. The container bodies are conveyed through the shield entrance zone into the tunnel 30 where they encounter a pair of air curtains which wipe the sides of the container bodies. The pressurized air curtains are produced by forcing dry filtered air through a supply 44 to a pair of curtaining manifolds 38. The air curtains form a corridor through which the container bodies move. A series of three or more ionizing nozzles subject the passing container bodies to a series of blasts of ionized air at pressures of 30 to 70 PSI. The ionized air which impinges on the interior of the container bodies neutralizes the static charge between the can body and the particulate contaminant, thereby freeing the particle and permitting it to be purged from the container. Upon leaving the mouth of the container, the ionized air with the particulate contaminante encounters the pressurized curtaining which constrains the dispersion of the ionized air with its particulate contaminant and sweeps the material outward under the tunnel wall and into the outer housing where it is saturated by the spray mist to separate the particulate contaminant from the ionized air and entrain it in the mist. The mist which condenses on the tray-base of cleaner forms a waste stream which is collected and discharges through a drain.

The importance of the pressure curtaining is readily appreciated if an attempt is made to operate the system without employing this feature. The ionized air with the particulate contaminant forms a cloud within the tunnel and the purged containers are quickly recontaminated.

While the instant invention has been described in terms of an ionized air blast, a pressurized air curtain and a water spray mist, it should be appreciated that variations in the particulate soil, environmental conditions or even the container configuration may suggest alternative media which are more effective but are still within the spirit of the invention.

For example, dry nitrogen is an effective substitute for air in the ionized blast, similarly fluids, either gaseous or liquid, may be substituted for air in the pressurized curtain. Plant trials for example showed that a pressurized water curtain could be employed effectively. Finally, water fortified with detergents or even organic fluid may be employed in the spray misting operation.

The structure may likewise be modified depending upon the operation conditions. For example, the tray base can incorporate a condenser coil to assist in the condensation of the spray mist, or alternatively a slotted pipe may be introduced at the forward end of the tray proximate the entrance to the housing to provide a film of flushing liquid to entrain the contaminated spray mist and carry off the soil in a waste stream. FIGS. 1 and 2 show a pipe 56 with slots 58. The slotted pipe being disposed transversely to the conveying means.

Figure 3:
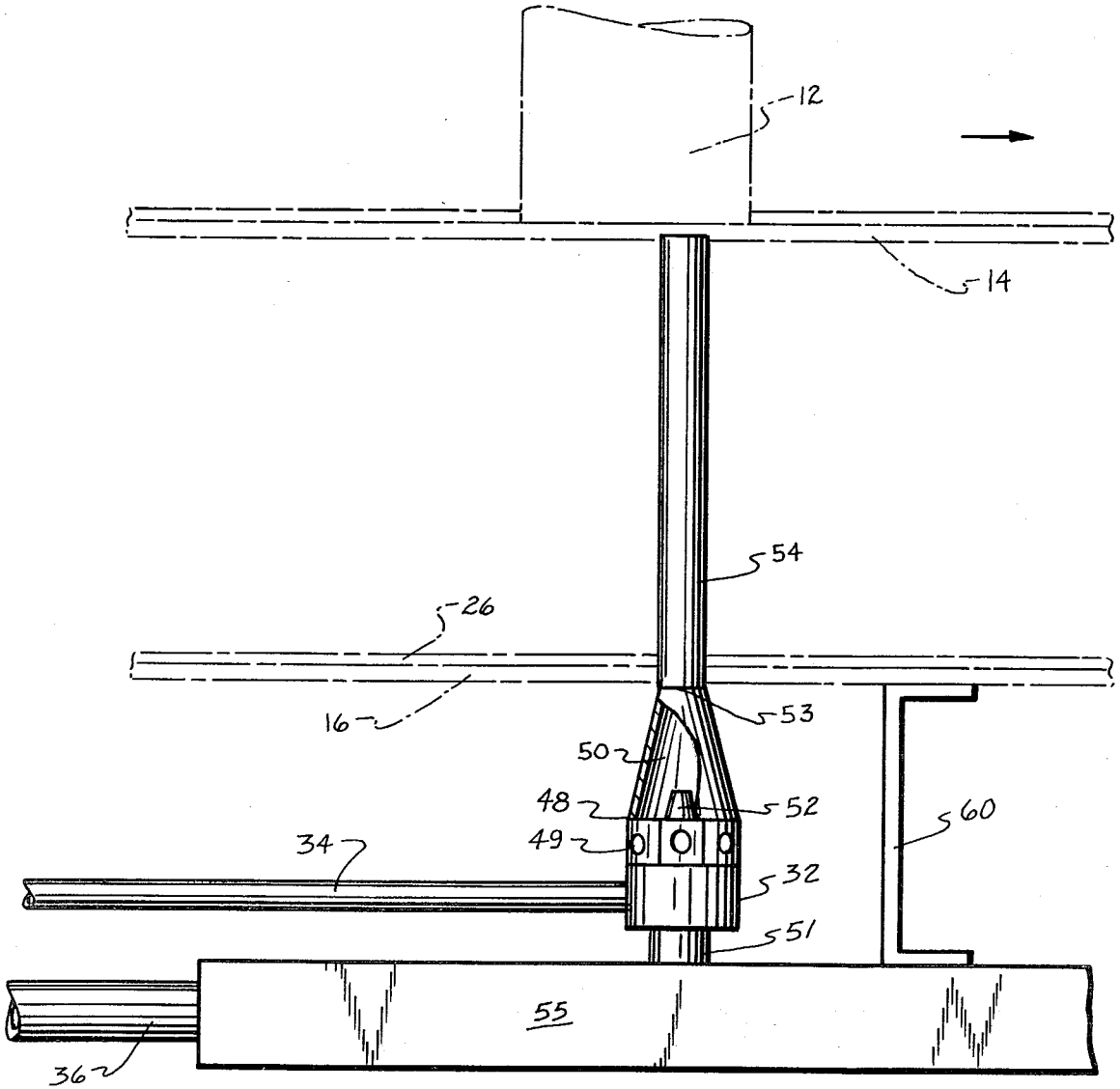
FIG. 3 is an alternative embodiment showing an ionizing nozzle provided with an extention tube and mounted on a plenum. The housing, conveyor rails and container body are indicated in phantom to illustrate the relationship between these elements and the nozzle features.

Under normal operating conditions, the pressurized curtain provided by manifolds 38 is sufficient to prevent the entry of spray mist into the ionization chamber of the ionizing nozzles. Occasionally, however, the conveyor may be stopped and the air supply temporarily disrupted. During such periods, there is a danger that moisture may inadvertantly enter the nozzle barrel 48 through vent means 49 which are provided to effect cooling of the ionizing element 52 when it is activated by energizing means 34. The presence of moisture in the ionizing chamber 50 can cause arcing and damage to the nozzle. To avoid this problem, the ionization nozzles may be positioned outside the housing. FIG. 3 shows the modified structure with nozzle 32 mounted outside and beneath housing 16. The housing, conveyor rails and container body are shown in phantom. While FIG. 3 shows a single nozzle 32 mounted on plenum 55 it should be appreciated that the other nozzles are similarly disposed. The plenum 55 is fabricated of 1"×1" stainless steel tubing and is rigidly mounted to the housing by a plurality of brackets 60 to ensure precise positioning of the nozzles relative to the path of conveyance. The nozzles are attached to the plenum by threading the gas inlet end 51 of the nozzle barrel into a tapped hole in the plenum wall. The plenum is sized to facilitate equal gaseous flow through each of the nozzles. The gas enters the nozzle barrel 48 through inlet 51, it passes into the ionization chamber 50 where it is ionized by ionizing element 52. The ionized gas leaves the nozzle through gas outlet 53, which is normally the terminal end of the nozzle body. To facilitate the remote positioning of the nozzle barrel and still ensure effective cleaning of the container bodies, a tubular extention 54 was added to the nozzle barrel. This tubular extention conveys the ionized gas to within $\frac{1}{8}''$ of the open end of the passing can body. Since the venting means 49 is no longer located within the housing the chance of entraining moisture in cooling air is substantially eliminated. As an alternate a nozzle with a separate cooling supply and no vent may be used.

Thus it can be seen that the instant invention provides method for effectively removing particulate contaminants from can bodies including those particles which are electrostatically attracted to the container walls.

It may further be seen that the instant invention provides a method which is compatible with high speed operations where cans are conveyed at speeds up to 1250 cans per minute.

Finally, it may be seen that the instant invention affords a means for cleaning cans which may be readily incorporated into a conveying line, which may be readily monitored, and which employs a minimum number of moving parts.

What is claimed is:

1. A method for cleaning particulate matter from the interior of hollow container bodies open at one end and closed at the other, comprising the steps of:

(a) establishing a corridor by providing two parallel pressurized fluid curtains;

(b) moving said container bodies open end down along said corridor between said pressurized curtains;

(c) subjecting the interior of said container bodies to an upwardly disposed blast of ionized gas to purge said particulate matter from said container bodies;

(d) entraining said expelled particulate matter in a liquid spray mist;

(e) condensing said mist to form a waste stream which includes said entrained particulate matter; and (f) collecting and discharging said waste stream.

2. The method of claim 1 wherein the curtain is pressured air.

3. The method of claim 1 wherein the curtain is water.

4. The method of claim 1 wherein the ionized gas is air.

5. The method of claim 1 wherein said mist surrounds said curtain.

6. A system for cleaning particulate matter from the interior of hollow container bodies open at one end comprising:

(a) means for supporting and conveying said container bodies open end downward;

(b) means disposed below said supporting and conveying means for ionizing a gas and for subjecting the interior of said container to a blast of said ionized gas;

(c) pressurized curtaining means disposed longitudinally along both sides of said supporting and conveying means to provide pressurized fluid curtains to constrain the dispersion of said ionized gas; and (d) housing means surrounding said curtaining means and provided with spray misting means for saturating and washing the region surrounding said curtaining means, to collect, separate and to entrain said particulate matter in said mist for removal from said housing.

7. A system for cleaning particulate matter from container bodies as recited in claim 6 and further comprising tunnel means disposed between said curtaining means and said housing means to prevent direct impingement of said spray mist on said pressurized fluid curtain.

8. A system for cleaning particulate matter from said container bodies as recited in claim 7 wherein said housing means further comprises a condensor as a bottom tray to condense said mist to form a waste stream for discharge.

9. A system for cleaning particulate matter from said container bodies as recited in claim 7 wherein said housing is transparent to permit monitoring of said system.

10. A system for cleaning particulate matter from the interior of hollow container bodies open at one end comprising:

(a) means for supporting and conveying said container bodies open and downward;

(b) a plurality of ionizing nozzles disposed below said supporting and conveying means for subjecting the interior of said container bodies to a blast of ionized gas, each of said nozzles having:

(i) an ionizing chamber defined by a substantially tubular barrel with a first end and a second end;

(ii) a gas inlet for receiving filtered, dry, pressurized gas, disposed in said first end;

(iii) a gas outlet disposed in said second end;

(iv) an ionizing element disposed within said ionizing chamber between said inlet and said outlet;

(v) energizing means operably connected with said ionizing element for activating said element whereby said pressurized gas entering said chamber through said inlet and exiting said chamber through said outlet is ionized;

(vi) venting means provided in said tubular barrel for entraining gas to cool said ionizing chamber;

(vii) a nozzle extension tube mounted on said second end to convey said ionized gas from said chamber outlet to said container body whereby said tubular barrel may be remotely disposed from said container body; and (c) pressurized curtaining means disposed longitudinally along both sides of said supporting and conveying means to provide pressurized fluid curtains to constrain the dispersion of said ionized gas; and (d) housing means provided with spray misting means and with an entrance and an exit surrounding said curtaining means including a cover, end panels, a base with the edges turned up to form a tray and wherein said base is provided with a plurality of openings to receive said nozzle extension tubes so that said tubular nozzle barrels may be disposed outside of said housing means.

11. A system for cleaning particulate matter from container bodies as recited in claim 10 and further comprising a plenum on which is mounted said plural ionizing nozzles, said plenum being of sufficient size to ensure equalized gaseous flow through each of said nozzles.

12. A system for cleaning particulate matter from container bodies as recited in claim 11 and further comprising a slotted pipe disposed across said tray transverse to said conveying means, said pipe being operably connected to a source of flushing liquid whereby said tray may be continuously flushed with a layer of said liquid to prevent accumulation of particulate matter.

* * * * *